US009360203B2

(12) United States Patent
Marinus et al.

(10) Patent No.: US 9,360,203 B2
(45) Date of Patent: Jun. 7, 2016

(54) ILLUMINATION DEVICE AND METHOD FOR ASSEMBLY OF AN ILLUMINATION DEVICE

(75) Inventors: Antonius Adrianus Maria Marinus, Eindhoven (NL); Omke Jan Teerling, 't Harde (NL); Bastiaan Uitbeijerse, Helmond (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 13/321,848

(22) PCT Filed: May 21, 2010

(86) PCT No.: PCT/IB2010/052282

§ 371 (c)(1), (2), (4) Date: Nov. 22, 2011

(87) PCT Pub. No.: WO2010/136950

PCT Pub. Date: Dec. 2, 2010

(65) Prior Publication Data

US 2012/0069570 A1 Mar. 22, 2012

(30) Foreign Application Priority Data

May 28, 2009 (EP) ..... 09161346
Jul. 22, 2009 (EP) ..... 09166081
May 6, 2010 (EP) ..... 10162146

(51) Int. Cl.
*F21V 3/00* (2015.01)
*F21V 5/00* (2015.01)
(Continued)

(52) U.S. Cl.
CPC ..... *F21V 29/86* (2015.01); *F21K 9/135* (2013.01); *F21K 9/1355* (2013.01); *F21V 3/02* (2013.01);
(Continued)

(58) Field of Classification Search
CPC ..... F21K 9/135
USPC ..... 362/257, 294, 296.01, 307, 310, 362/311.01–311.05, 311.14, 311.15, 351, 362/353, 360, 249.01, 249.02, 255
See application file for complete search history.

(56) References Cited

U.S. PATENT DOCUMENTS 1,753,273 A * 4/1930 Laib ..... 362/255
5,083,251 A * 1/1992 Parker ..... 362/255
(Continued)

FOREIGN PATENT DOCUMENTS

CN 201344404 11/2009
DE 196240871 A1 12/1997
(Continued)

*Primary Examiner* — Peggy Neils
*Assistant Examiner* — Alexander Garlen

(57) ABSTRACT

The present invention discloses an illumination device (100) and a method (4000) for assembly of such an illumination device. The illumination device (100) comprises a light source (110) arranged to generate light, a carrier (120) arranged to support the light source and an envelope (130) enclosing the light source and the carrier. The envelope comprises at least two enveloping parts which, when joined together, form the envelope. Further, the carrier is arranged in thermal contact with at least one of the enveloping parts for dissipating heat out of the illumination device. The method comprises the steps of mounting (4100) the light source in thermal contact with the carrier and enclosing (4200) the light source and the carrier with the envelope. The present invention is advantageous in that it provides a convenient design which facilitates the assembly of the illumination device. Further, the present invention is advantageous in that it provides an illumination device with improved heat transfer.

13 Claims, 4 Drawing Sheets

(51) Int. Cl.

| | |
|---|---|
| ***F21V 29/85*** | (2015.01) |
| ***F21V 3/02*** | (2006.01) |
| ***F21V 3/04*** | (2006.01) |
| ***F21K 99/00*** | (2016.01) |
| *F21V 19/00* | (2006.01) |
| *F21Y 101/02* | (2006.01) |

(52) U.S. Cl.

CPC ..... *F21V 3/0409* (2013.01); *F21V 19/003* (2013.01); *F21V 19/006* (2013.01); *F21Y 2101/02* (2013.01); *Y10T 29/49002* (2015.01)

(56) References Cited

U.S. PATENT DOCUMENTS

| | | | | |
|---|---|---|---|---|
| 5,165,784 | A * | 11/1992 | Loth et al. | 362/255 |
| 5,749,646 | A | 5/1998 | Brittell | |
| 6,626,554 | B2 * | 9/2003 | Rincover et al. | 362/186 |
| 7,261,437 | B2 * | 8/2007 | Coushaine et al. | 362/255 |
| 7,461,951 | B2 * | 12/2008 | Chou et al. | 362/294 |
| 7,575,339 | B2 * | 8/2009 | Hung | 362/230 |
| D626,257 | S * | 10/2010 | Pickard | D26/2 |
| 7,976,182 | B2 * | 7/2011 | Ribarich | 362/221 |
| 8,220,956 | B2 | 7/2012 | Lai et al. | |
| 8,227,962 | B1 * | 7/2012 | Su | 313/46 |
| 8,317,358 | B2 | 11/2012 | Chou | |
| 8,547,002 | B2 * | 10/2013 | Lenk et al. | 313/46 |
| 8,894,238 | B2 | 11/2014 | Marinus et al. | |
| 2005/0189557 | A1 | 9/2005 | Mazzochette et al. | |
| 2006/0043546 | A1 | 3/2006 | Kraus | |
| 2006/0098440 | A1 | 5/2006 | Allen | |
| 2006/0227558 | A1 | 10/2006 | Osawa et al. | |
| 2006/0274529 | A1 | 12/2006 | Cao | |
| 2007/0230188 | A1 | 10/2007 | Lin | |
| 2008/0013316 | A1 * | 1/2008 | Chiang | 362/264 |
| 2008/0310158 | A1 | 12/2008 | Harbers et al. | |
| 2009/0080187 | A1 | 3/2009 | Chou | |
| 2009/0161359 | A1 * | 6/2009 | Siemiet et al. | 362/235 |
| 2010/0008086 | A1 | 1/2010 | Broitzman | |
| 2010/0314985 | A1 * | 12/2010 | Premysler | 313/46 |
| 2011/0089838 | A1 * | 4/2011 | Pickard et al. | 315/113 |
| 2012/0069570 | A1 | 3/2012 | Marinus et al. | |
| 2012/0134158 | A1 | 5/2012 | Yang et al. | |

FOREIGN PATENT DOCUMENTS

| | | | |
|---|---|---|---|
| DE | 202007008258 | U1 | 12/2007 |
| DE | 202008016867 | U1 | 4/2009 |
| JP | 08293204 | A | 11/1996 |
| JP | 2001243809 | A | 9/2001 |
| JP | 08293204 | | 9/2007 |
| JP | 2007234639 | A | 9/2007 |
| WO | 2008077627 | A1 | 7/2008 |
| WO | 2008078235 | | 7/2008 |
| WO | 2008078235 | A2 | 7/2008 |
| WO | 2008154172 | A1 | 12/2008 |
| WO | 2009021695 | A1 | 2/2009 |
| WO | 2009150574 | A1 | 12/2009 |

* cited by examiner

ILLUMINATION DEVICE AND METHOD FOR ASSEMBLY OF AN ILLUMINATION DEVICE

FIELD OF THE INVENTION

The present invention relates to an illumination device and to a method for assembly of an illumination device.

BACKGROUND OF THE INVENTION

Light-emitting-diode (LED) lamps are known in the art. A LED lamp is a lamp that uses LEDs as the source of light. In such lamps, multiple diodes may be used for either increasing the output power of the lamp or for providing a white light as a single LED emits in a narrow band of wavelengths. LED lamps may be used for general lighting or even more specific lighting as the colour and the output power may be tuned.

Generally, a lamp or illumination device comprises a light source arranged to generate light and mounted on, or at least connected to, a circuit board. The light source is arranged within an encapsulating housing usually having the shape of a bulb. In addition to provide maximum light output and/or a specific colour of light, the design of an illumination device needs to take into account the evacuation of heat generated by the light source(s) and/or the electronics connected to the light source(s).

For example, American patent application US2010/0008086 discloses a white LED-based lighting device comprising a group of solid state light emitting diodes, electronics to activate the light emitting diodes and an encapsulating housing. For conducting or transferring outwardly heat generated from within the white light LED device, the encapsulating housing includes air vents and heat-sinking components.

SUMMARY OF THE INVENTION

Generally, a disadvantage of prior art systems may be that such systems require a high number of components including specific details for evacuation of heat (e.g. an encapsulating housing, light source(s), a circuit board, air-vents and heat sinking components), thereby rendering the assembly of the system rather complex.

Hence, it is an object of the present invention to alleviate the above mentioned drawback, and to provide an illumination device having a convenient design for facilitating its assembly.

This and other objects of the present invention are achieved by means of an illumination device and a method for assembly of an illumination device as defined by the independent claims. Other advantageous embodiments of the present invention are defined by the dependent claims.

According to a first aspect of the invention, an illumination device as defined in claim 1 is provided. The illumination device comprises a light source arranged to generate light, a carrier arranged to support the light source and an envelope enclosing the light source and the carrier. The light source is in thermal contact with the carrier and the envelope comprises at least two enveloping parts which, when joined together, form the envelope. The carrier is arranged in thermal contact with at least one of the enveloping parts for dissipating heat out of the illumination device.

According to a second aspect of the present invention, a method for assembly of an illumination device comprising a light source arranged to generate light as defined in claim 11 is provided. The method comprises the steps of mounting the light source in thermal contact with a carrier and enclosing the light source by joining at least two enveloping parts, thereby forming an envelope enclosing the light source. The carrier is arranged in thermal contact with at least one of the enveloping parts for dissipating heat out of the illumination device.

The present invention makes use of an understanding that the envelope or bulb of an illumination device may comprise at least two enveloping parts which, when joined together, form the envelope (or encapsulating housing of the illumination device). The present invention is advantageous in that it provides a convenient design which facilitates the assembly of an illumination device (such as a lamp or spot light). Using two enveloping parts, the light source and the carrier may conveniently be mounted together while the two enveloping parts are separated and then enclosed in the envelope by joining the two enveloping parts. It will be appreciated that more than two enveloping parts may be employed and that the present invention is not limited to an illumination device comprising an envelope made of only two enveloping parts.

The present invention makes also use of an understanding that the envelope (or bulb) of the illumination device may act as a heat sink and serve for dissipating heat (e.g. generated by the light source or any electronics connected to the light source) out of the illumination device. For this purpose, the light source is arranged in thermal contact with a carrier which itself is in thermal contact with at least one of the enveloping parts of the envelope. With the present invention, the whole surface of the illumination device, i.e. the envelope, acts as a heat sink. Thus, the present invention is advantageous in that an effective transfer of heat to the outside environment of the illumination device is provided.

According to an embodiment, the carrier and the envelope may be made of ceramic material, which is advantageous in that it is a kind of material having good thermal conductivity, thereby allowing a relative efficient transfer of heat. For example, the ceramic material may be poly crystalline aluminium oxide (PCA), which is advantageous in that it is a translucent ceramic material.

According to an embodiment, the envelope may have the shape of a bulb (or lamp bulb). In particular, the enveloping parts may be two bulb halves.

According to an embodiment, an enveloping part and at least part of the carrier (or a first part of the carrier or first carrier) may form a single integrated part, which is advantageous in that the number of components is reduced, thereby facilitating even further the assembly of the illumination device. The present embodiment is also advantageous in that the enveloping part and the part of the carrier (e.g. a bulb half and half of the carrier) may be manufactured as one single part from one single mould. The corresponding enveloping part(s) and part of the carrier for forming the envelope and the carrier may also be manufactured from one single mould, preferably the same mould.

According to another embodiment, the carrier may be arranged at a junction between two enveloping parts. In the present embodiment, the carrier and the enveloping parts are separate parts.

According to an embodiment, the enveloping parts may advantageously be configured to fit one to another, thereby facilitating the assembly of the illumination device.

According to an embodiment, the carrier may be arranged along an axis extending from the base of the illumination device to its top. Alternatively, the carrier may be arranged along a direction crossing an axis extending from the base of the illumination device to its top. In these embodiments, the carrier divides the space defined by the envelope in at least two compartments. A plurality of light sources may then advantageously be used and distributed on each side of the carrier such that an uniform illumination is provided.

According to an embodiment, the envelope may comprise a transmissive region arranged to transmit at least part of the light generated by the light source (especially when the light source emits in the visible range of the wavelength spectrum, i.e. 380-780 nm). The transmissive region may be translucent (transmitting and scattering of light) or be transparent (substantial unhindered transmission). Advantageously, the transmissive region is translucent, thereby preventing a user from perceiving the light source(s) and optional electronics within the envelope. As mentioned above, the envelope may be made of PCA, thereby providing a translucent envelope. Thus, the envelope or encapsulating housing of the illumination device is advantageous in that it integrates a number of functionalities such as an optical function, a thermal function and a mechanical function.

According to an embodiment, the carrier may comprise a reflective region arranged to reflect at least part of the light generated by the light source(s). Alternatively or in addition, the carrier may comprise a transmissive region arranged to transmit at least part of the light generated by the light source.

According to an embodiment, the light source may be at least one light emitting diode (LED) or at least one LED package. The light source may for instance comprise an RGB LED (red green blue light emitting diode), or a plurality of diodes arranged to provide white light, such as an RGB combination, or a combination of blue and yellow, or a combination of blue, yellow and red, etc. Optionally, the illumination device may be arranged to provide coloured light.

The light source may also comprise a plurality of light sources (such as a plurality of LEDs), that is (are) able to provide light at different predetermined wavelengths, depending upon the driving conditions. Hence, in a specific embodiment, the illumination device may further comprise a controller (attached to or external from the illumination device), arranged to control the colour of the illumination device light in response to a sensor signal or a user input device signal.

In the following, the invention may be further described with reference to a LED as preferred embodiment of the light source. Hence, in the following the term "LED" may also refer to a light source (or a plurality of light sources) in general, unless indicated otherwise or clear from the context, but preferably refers to a LED. Further, the term "LED" especially refers to solid state lighting (solid state LEDs).

According to an embodiment, the light source may emit light in the visible range, but may also, in another embodiment, alternatively or additionally emit in the UV range. As mentioned above, the light source may comprise a LED. In a further embodiment, the light source is a LED arranged to generate blue light. The blue light emitting source may be used per se, or may be used in combination with luminescent material, e.g. arranged at the envelope or at least one of the enveloping parts, such as to provide white light, or may be used in combination with one or more other LEDs generating light at other wavelengths. Combinations of such embodiments may also be applied.

According to an embodiment, the carrier or part of the carrier may be glued to an enveloping part of the envelope. Advantageously, the glue has good thermal properties such that heat can be dissipated from the carrier to the enveloping part.

Alternatively, the carrier may be inserted at a junction between two enveloping parts. In the present example, the carrier is advantageously pressed between two enveloping parts such that a good thermal contact is provided between the carrier and the enveloping parts for heat dissipation.

According to an embodiment, a base of the envelope (or illumination device) is inserted in a socket acting as an holder. The socket may also be configured to provide electricity to the light source.

In the present application, the term "at least" may in embodiments also indicate "all" or "completely".

It is noted that the invention relates to all possible combinations of features recited in the claims.

BRIEF DESCRIPTION OF THE DRAWINGS

This and other aspects of the present invention will now be described in more detail, with reference to the appended drawings showing various exemplifying embodiments of the invention.

DETAILED DESCRIPTION

Figure 1:
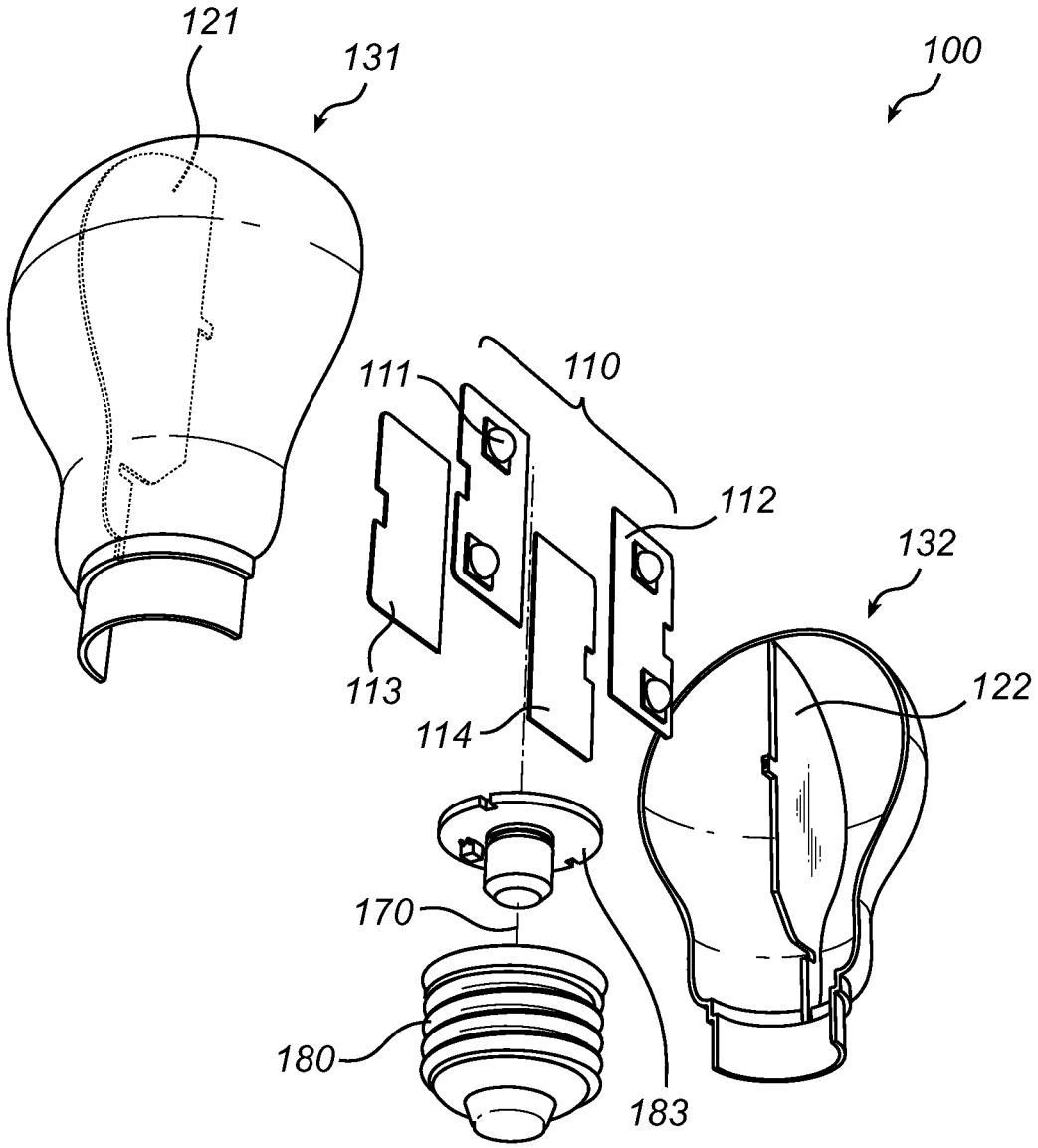
FIG. 1 is an exploded view of an illumination device according to an exemplifying embodiment of the present invention.

With reference to FIG. 1, a first embodiment of the present invention is described.

FIG. 1 shows an exploded view of an illumination device 100 according to an embodiment of the present invention. The illumination device comprises a light source 110 arranged to generate light. In the present example, the light source 110 corresponds to a plurality of LED packages 111, 112, 113 and 114. Although FIG. 1 shows a plurality of LED packages to form the light source 110, a single light source may also be used.

The illumination device 100 further comprises two carrier parts 121 and 122 (or a first carrier 121 and a second carrier 122) arranged to support the light source 110 or LED packages 111-114. In the following, the two carrier parts 121 and 122 may also be referred to as a single carrier, when the two parts are intended to be joined together, and will generally be referred to as a carrier 120.

The illumination device 100 comprises also two enveloping parts 131 and 132 which, when joined together, form an envelope or encapsulating housing generally denoted as a single envelope 130 in the following. The envelope 130 encloses the light sources 111-114 and the carriers 121 and 122. The light sources 111-114 (or light source 110) are arranged in thermal contact with the carriers 121 and 122. The carrier 120 is arranged in thermal contact with the enveloping parts 131 and 132, respectively.

Using such a design, when the illumination device is powered on, heat may be generated by the light source(s) 111-114 and be dissipated out of the illumination device 100 via the carriers 121 and 122 and the enveloping parts 131 and 132.

In the present embodiment, the first and second carriers 121 and 122 divide the illumination device 100 in two compartments. Advantageously, the light source(s) 111-114 of the illumination device may be distributed on each side of the first and second carriers 121 and 122 for improving the uniformity of the light emitted from the illumination device 100.

The envelope 130 may especially be arranged to receive all light from the light source(s) 111-114. Further, the envelope 130 may especially be arranged to allow escape of light of the light source(s) 111-114.

When a plurality of light sources are used and the light sources emit light at different wavelengths, the envelope 130 may thus also be indicated as a mixing chamber. Mixing may also be of relevance when a luminescent material is used that is arranged remote from a light source (from which it absorbs part of the light to provide luminescent material light), e.g. arranged at the envelope or part of the envelope.

Advantageously, the envelope 130 may comprise a transmissive region arranged to transmit at least part of the light generated by the light sources 111-114.

According to an embodiment, the carrier 120 may also comprise a transmissive region, which is advantageous in that light coming from a compartment of the envelope in direction to the carrier may be transmitted through the carrier and, then, transmitted out of the illumination device via the envelope 130. In particular, the envelope 130 may be made of a material having light transmissive properties such that an efficient transmission of light through the envelope is achieved.

Alternatively, or in addition, the carrier 120 may comprise a reflective region arranged to reflect at least part of the light generated by the light source(s), which is advantageous in that light emitted in a compartment of the envelope and directed towards the carrier may be reflected against the carrier and transmitted out of the illumination device via the same compartment of the envelope. It will be appreciated that the carrier may be designed with a number of various regions being either transmissive or reflective such that, e.g., a desired light distribution is achieved.

In the embodiment shown in FIG. 1, the envelope 130 is bulb-shaped and the enveloping parts 131 and 132 are two bulb halves, thereby providing an illumination device which has a standard lamp shape.

According to an embodiment, both the envelope and the carrier comprises ceramic material, which is advantageous in that it improves the transfer of heat from the illumination device.

The term "ceramic" is known in the art and may especially refer to an inorganic, non-metallic solid prepared by the action of heat and subsequent cooling. Ceramic materials may have a crystalline or partly crystalline structure, or may be amorphous, i.e., a glass. Most common ceramics are crystalline. The term ceramic especially relates to materials that have sintered together and form pieces (in contrast to powders). The ceramics used herein are preferably polycrystalline ceramics.

The ceramic material may for instance be based on one or more materials selected from the group consisting of $Al_2O_3$, AlN, $SiO_2$, $Y_3Al_5O_{12}$ (YAG), an $Y_3Al_5O_{12}$ analogue, $Y_2O_3$ and $TiO_2$, and $ZrO_2$. The term an $Y_3Al_5O_{12}$ analogue refers to garnet systems having substantially the same lattice structure as YAG, but wherein Y and/or Al and/or O, especially Y and/or Al are at least partly replaced by another ion, such as one or more of Sc, La, Lu and G, respectively.

According to an embodiment, the ceramic material may be $Al_2O_3$, which is a translucent material. $Al_2O_3$ can also be made highly reflective when it is sintered at a temperature in the range of about 1300-1700° C., such as in the range of about 1300-1500° C., like 1300-1450° C. This material is also known in the art as "brown" PCA (polycrystalline alumina).

The term "based on" indicates that the starting materials to make the ceramic material substantially consist of one or more of the herein indicated materials, such as for instance $Al_2O_3$ or $Y_3Al_5O_{12}$ (YAG). This does however not exclude the presence of small amounts of (remaining) binder material, or dopants, such as Ti for $Al_2O_3$, or in an embodiment Ce for YAG.

The ceramic material may have a relatively good thermal conductivity. Preferably, the thermal conductivity is at least about 5 W/mK, such as at least about 15 W/mK, even more preferably at least about 100 W/mK. YAG has a thermal conductivity in the range of about 6 W/mK, poly crystalline alumina (PCA) in the range of about 20 W/mK, and AlN (aluminum nitride) in the range of about 150 W/mK or larger.

Referring again to FIG. 1, the illumination device 100 may also comprise a socket 180 for holding the enveloping parts 131 and 132 and for providing, via a connecting board 183, electricity to the LED packages 111-114.

Figure 4A:
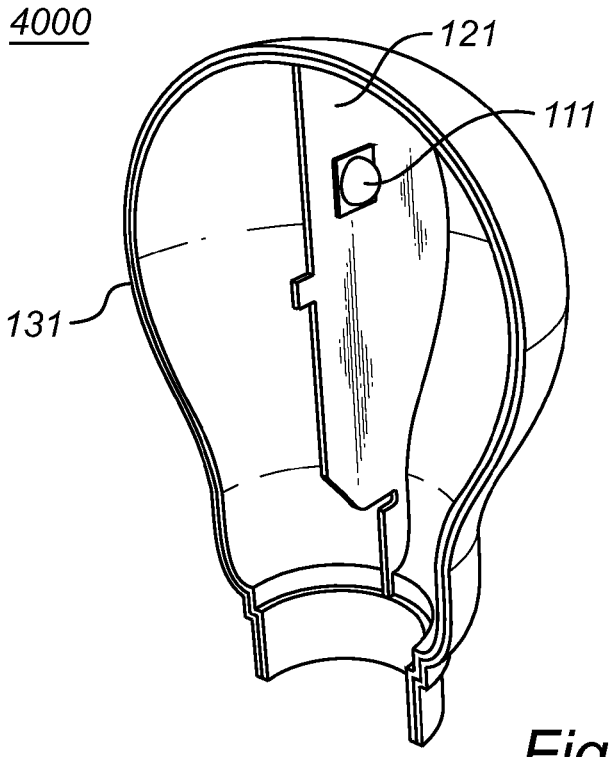
FIG. 4*a*-4*c* illustrate, in a schematic manner, a process flow of the method for assembly of an illumination device according to an exemplifying embodiment of the present invention.

According to an embodiment, referring to e.g. FIG. 1 and FIG. 4*a*, an enveloping part 131 and a part 121 of the carrier form a single integrated part. Such an embodiment is advantageous in that it further reduces the number of components for assembling the illumination device, thereby facilitating even more its assembly.

Figure 2:
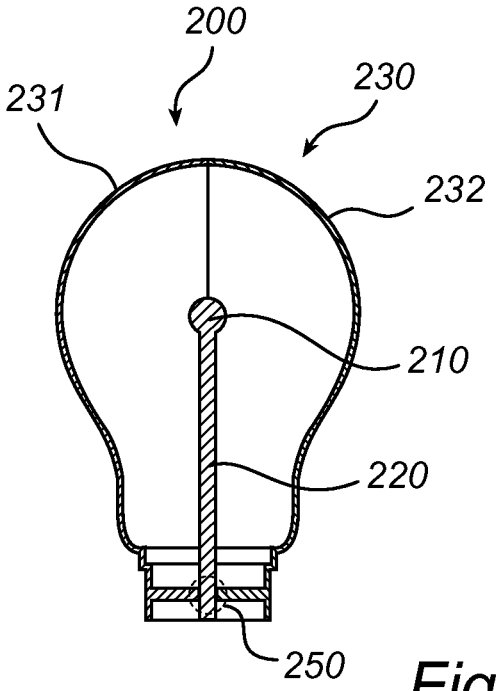
FIG. 2 is a schematic view of an illumination device according to another exemplifying embodiment of the present invention.

Referring to FIG. 2, another embodiment of the present invention is described.

FIG. 2 is a schematic view of an illumination device 200 comprising a light source 210, which may be a LED, arranged to generate light, a carrier 220 arranged to support the light source 210 and two enveloping parts 231 and 232 which, when joined together, form an envelope or encapsulating housing 230. The carrier 220 is arranged in thermal contact with the light source 210 and the carrier 220 is arranged at a junction 250 between the two enveloping parts 231 and 232. The junction 250 provides for a mechanical interface and a thermal interface between the carrier 220 and the enveloping parts 231 and 232. As for the embodiment described with reference to FIG. 1, heat generated by the light source 210 is dissipated outside the illumination device 200 by heat transfer via the carrier 220 and through the envelope 200.

With reference to any embodiments described above with reference to FIGS. 1 and 2, the enveloping parts of the envelope 130 or 230 of the illumination devices 100 and 200, respectively, are configured to fit one to another.

Figure 3:
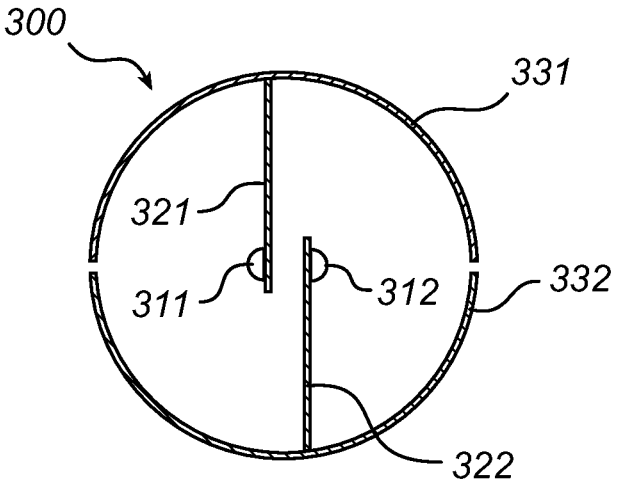
FIG. 3 is a schematic view of an illumination device according to another exemplifying embodiment of the present invention.

With reference to FIG. 3, another embodiment of the present invention is described.

FIG. 3 is a schematic top view of an illumination device 300 comprising two light sources 311 and 312, e.g. two LEDs, arranged to generate light. The two LEDs 311 and 312 are mounted on two carriers 321 and 322 (or two parts of a carrier) arranged to support the LEDs 311 and 312, respectively. In the present embodiment, a single LED package is mounted on, or attached to, a carrier. Alternatively, a plurality of LED packages may be mounted on a first carrier.

As illustrated in FIG. 3, the first carrier 321 attached to a first enveloping part 331 of the envelope may extend in the volume defined by the second enveloping part 332 of the envelope when the two enveloping parts are joined together. Similarly, the second carrier 322 attached to the second enveloping part 332 of the envelope may extend in the volume defined by the first enveloping part 331 of the envelope when the two enveloping parts are joined together. In other words, the first carrier 321 and the second carrier 322 may not be exactly arranged in front of each other but, instead, slightly displaced.

In the present embodiment, as for the embodiments described with reference to FIGS. 1 and 2, the carriers 321 and 322 are arranged along an axis 170 (see FIG. 1) extending from the base of the illumination device to its top.

Alternatively, the carrier may be arranged along a direction crossing the axis 170 extending from the base of the illumination device to its top.

In either case, the carriers define compartments within the envelope of the illumination device.

Figure 4B:
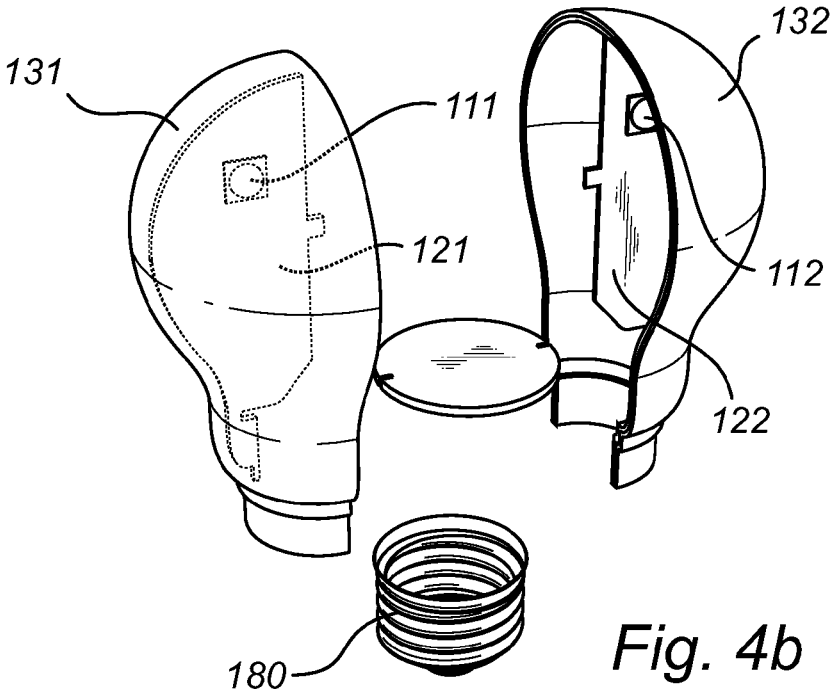
Figure 4C:
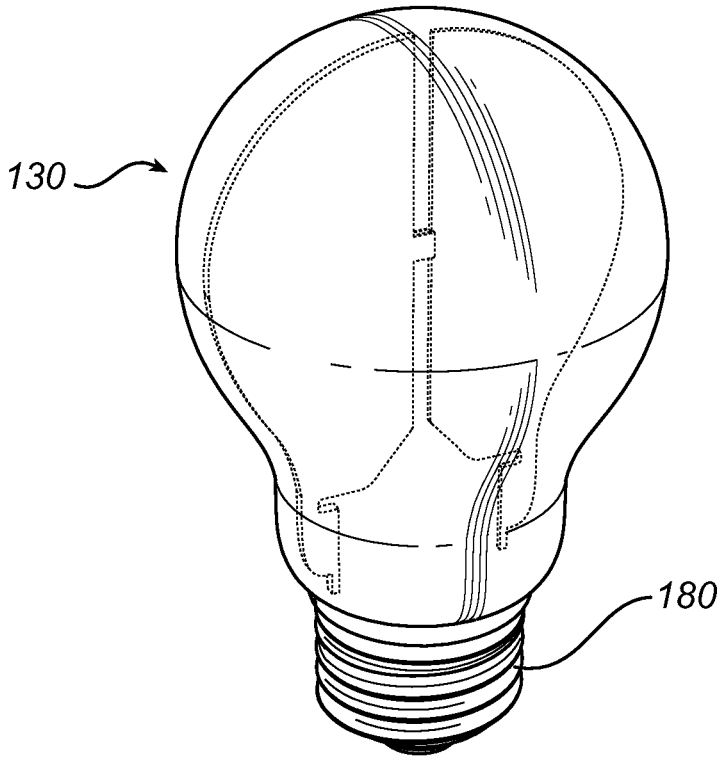

With reference to FIGS. 4*a*-4*c*, a process flow 4000 describing a method for assembly of an illumination device is described.

FIGS. 4*a*-4*c* schematically illustrate the assembly of an illumination device comprising a first bulb half 131 with a first carrier 121 on which a first light source 111 is mounted and a second bulb half 132 with a second carrier 122 on which a second light source 112 is mounted.

FIG. 4*a* shows the first enveloping part or bulb half 131 comprising the first carrier 121. The first bulb half 131 and the first carrier 121 may be a single integrated part, e.g. made out of a single mould. Alternatively, the first carrier 121 and the first bulb half are two separate parts and the first carrier 121 may be glued to the inside of the first bulb half 131. Advantageously, the glue has good thermal conductive properties such that heat can effectively be transferred from the first carrier 121 to the first bulb half 131.

In a first step 4100, a light source 111 is mounted in thermal contact with the first carrier 131. The light source 111 may for instance be attached to the carrier by means of a clip.

A similar step may then be applied with the second carrier 132 to which a second light source 112 is mounted in thermal contact.

In a second step 4200, the first light source 111, the first carrier 121, the second light source 112 and the second carrier 122 are enclosed by joining the two enveloping parts 131 and 132, such as illustrated in FIG. 4*b*.

As a result, an envelope 130 such as shown in FIG. 4*c* is formed. The envelope 130 may then be inserted in a socket 180 for holding the two enveloping parts 131 and 132. The socket 180 may also be configured to provide electricity to the illumination device such that electrical power can be transmitted to the light sources 111 and 112.

In this respect, the light source may advantageously be high-voltage (HV) LEDs, which is advantageous in that the number of components necessary to form the illumination device is further reduced as HV LEDs do not require any driver.

Even more advantageously, phase-shifted HV LEDs may be used and distributed on the carrier 130 (or the carriers 131 and 132) for preventing any stroboscopic effect.

The present invention may be useful for any kind of lamps such as a spot light or a standard lamp. The present invention may be applied for illumination devices used in homes, hospitality, outdoor, offices, industry and retail.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

For example, although the embodiments described above relate to an illumination device having a standard bulb shape, any other suitable shape may be envisaged. Further, although the embodiments described above comprise a first and a second carrier, it will be appreciated that the illumination device may comprise only one carrier in thermal contact with at least one of the enveloping parts. Further, the illumination device may also comprise more than two carriers or carrier parts.

Further, although the present invention has been described with reference to two enveloping parts for forming the envelope or encapsulating housing (or bulb), the present invention is not limited to such an embodiment and more than two enveloping parts may be used to form the envelope of the illumination device.

It will also be appreciated that the number of LEDs or light sources and their respective wavelengths will be selected in accordance with the desired application.

The invention claimed is:

1. A bulb-shaped illumination device comprising:

at least two light sources arranged to generate light, a carrier comprising two or more carrier parts, the carrier arranged to support said light sources, said light sources being in thermal contact with said carrier, and a bulb-shaped envelope enclosing said light sources and said carrier within an open interior space, the envelope integrated with a threaded annular socket, wherein said envelope comprises at least two enveloping parts which, when joined together, form said envelope and the surface of the illumination device, wherein the carrier is arranged in thermal contact with at least one of the enveloping parts for dissipating heat from said light sources out of said illumination device, the carrier extending inwardly from the at least one enveloping part, the carrier positioned to divide a light mixing space defined within the envelope into at least two compartments, the light sources positioned on each side of the carrier with a first light source on a first carrier side in a first compartment and a second light source on a second carrier side in a second compartment and facing away from said first light source in an outward direction of the envelope, and the envelope extending around the carrier and to the socket to form a heat sink and enclosing the first light source, the second light source, and the carrier and forming the bulb shape illumination device;

wherein a curved outer contour defined by the two or more carrier parts matches a curved inner contour defined by an inner surface of at least one of the enveloping parts in a direction parallel to a longitudinal axis of the bulb-shaped illumination device from a top of the illumination device to a position adjacent a portion of the at least one enveloping part that is inserted into the threaded annular socket.

2. An illumination device as defined in claim 1, wherein both the envelope and the carrier comprises ceramic material.

3. An illumination device according to claim 1, wherein the enveloping parts are two bulb halves.

4. An illumination device according to claim 1, wherein the at least one enveloping part and at least part of the carrier form a single integrated molded part.

5. An illumination device according to claim 1, wherein the carrier is arranged at a junction between two enveloping parts.

6. An illumination device according to claim 1, wherein the enveloping parts are configured to fit one to another.

7. An illumination device according to claim 1, wherein said envelope comprises a transmissive region arranged to transmit at least part of the light generated by the light sources.

8. An illumination device according to claim 1, wherein said carrier comprises a transmissive region arranged to transmit at least part of the light generated by the light sources or a reflective region arranged to reflect at least part of the light generated by the light sources.

9. An illumination device according to claim 1, wherein the light sources comprises at least one light emitting diode (LED) or at least one LED package.

10. Method for assembly of a bulb shaped illumination device comprising a plurality of light sources arranged to generate light, said method comprising the steps of:

mounting said light sources in thermal contact with a carrier comprising two or more carrier parts, enclosing said light sources and the carrier by joining at least two enveloping parts, thereby forming a bulb shaped envelope enclosing said light sources in an open interior space, the carrier being arranged in thermal contact with at least one of the enveloping parts to dissipate heat from the light sources out of said illumination device, the joined enveloping parts forming an outer surface of the bulb shaped illumination device, wherein the carrier defines a divided space in the envelope of at least two compartments, the light sources distributed on each side of the carrier and in each of the compartments, the light sources are positioned in each compartment facing away from each other, the joining of the enveloping parts forming the at least two compartments; and wherein a curved outer contour defined by the two or more carrier parts matches and is in direct contact with a curved inner contour defined by an inner surface of at least one of the at least two enveloping parts in a direction parallel to a longitudinal axis of the bulb-shaped illumination device from a top of the illumination device across a portion of the bulb-shaped illumination device that is widest in a direction perpendicular to the longitudinal axis.

11. Method as defined in claim 10, further comprising the step of gluing said carrier to an enveloping part.

12. Method as defined in claim 10, wherein both the envelope and the carrier comprises ceramic material.

13. An illumination device comprising a plurality of LEDs, a first and second carrier dividing a light mixing space within a bulb-shaped envelope which encloses the LEDs, the first and second carrier supporting the plurality of LEDs, the LEDs distributed on a first side of said first carrier and on a second opposing side of said second carrier, the second side of the second carrier on an opposing side of the first side of the first carrier; the first and the second opposing sides of the carriers facing away from each other;

the first and second carrier arranged in thermal contact with the envelope for dissipating heat out of said illumination device;

the first carrier extending inwardly from a first enveloping part, the second carrier extends inwardly from a second enveloping part;

the first enveloping part and second enveloping part joined together to form the envelope, the envelope extending to a socket, the socket in electrical communication with the plurality of LEDs, the formed envelope enclosing the plurality of LEDs, the first carrier, the second carrier and forming an external surface of the illumination device;

wherein a curved outer contour defined by at least one of the first and second carriers matches and is in direct contact with a curved inner contour defined by an inner surface of at least one of the first and second enveloping parts in a direction parallel to a longitudinal axis of the illumination device from a top of the illumination device to a position adjacent a portion of the at least one enveloping part that is inserted into the socket.

* * * * *